United States Patent [19]

Bartscher

[11] Patent Number: 5,046,152

[45] Date of Patent: Sep. 3, 1991

[54] IGNITION CIRCUIT FOR A GAS DISCHARGE LAMP

[75] Inventor: Bernd Bartscher, Wiesbaden, Fed. Rep. of Germany

[73] Assignee: Heimann GmbH, Fed. Rep. of Germany

[21] Appl. No.: 526,010

[22] Filed: May 21, 1990

[30] Foreign Application Priority Data

Sep. 20, 1989 [DE] Fed. Rep. of Germany ..... 3931407

[51] Int. Cl.[5] ..... H05B 39/04

[52] U.S. Cl. ..... 315/307; 315/299; 315/301; 315/311; 315/241 P

[58] Field of Search ..... 315/307, 299, 301, 311, 315/241 P

[56] References Cited

U.S. PATENT DOCUMENTS

| | | | |
|---|---|---|---|
| 3,846,811 | 11/1974 | Nakamura et al. | 315/241 P |
| 4,442,382 | 4/1984 | Fleck | 315/307 |
| 4,742,277 | 5/1988 | Shibuya et al. | 315/241 P |
| 4,868,461 | 9/1989 | Debus et al. | 315/209 SC |

*Primary Examiner*—Eugene R. LaRoche
*Assistant Examiner*—Tan Dinh
*Attorney, Agent, or Firm*—Hill, Van Santen, Steadman & Simpson

[57] ABSTRACT

Ignition circuit for a gas discharge lamp. In the ignition circuit, the generating of uniform current pulses for ignition over the entire useful life of the gas discharge lamp is guaranteed. A control circuit is provided for holding constant the current-time integral of current pulses applied to the gas discharge lamp during ignition.

4 Claims, 2 Drawing Sheets

FIG 1

IGNITION CIRCUIT FOR A GAS DISCHARGE LAMP

BACKGROUND OF THE INVENTION

The present invention is directed to an ignition circuit for a gas discharge lamp having a first power source for generating a heating current that effects a pre-ionization but that does not cause an ignition, having a second power source that is additionally connectible to the gas discharge lamp via a switch for ignition, and having means for generating a pulse return after the ignition, whereby the first power source is connected to the gas discharge lamp at an anode side and the second power source is connected to the gas discharge lamp at a cathode side.

In an ignition circuit of this type, the pre-ionization serves the purpose of meeting the demand for a steep rise in the light pulse given a low phase jitter. Overall, a light pulse is generated having a steep rise, a flatter decay and a pulse return at its end.

SUMMARY OF THE INVENTION

It is an object of the present invention to provide an ignition circuit of the type initially cited such that uniform light pulses are achieved with high electrical efficiency for high opto-electrical efficiency, particularly in the blue range of light, without disturbing color temperature changes over the useful life of the gas discharge lamp.

This object is inventively achieved by a control means for keeping constant the current-time integral of the current pulses through the gas discharge lamp. This control means compensates for differences in the current rise times, which particularly occur in gas discharge lamps that have aged, by varying the pulse width. Without such control, that is, for circuits using a constant pulse width, these differences lead to visible differences in brightness or flickering of the gas discharge lamp.

BRIEF DESCRIPTION OF THE DRAWINGS

The features of the present invention which are believed to be novel, are set forth with particularity in the appended claims. The invention, together with further objects and advantages, may best be understood by reference to the following description taken in conjunction with the accompanying drawings, in the several Figures in which like reference numerals identify like elements, and in which:

DESCRIPTION OF THE PREFERRED EMBODIMENT

Figure 1:
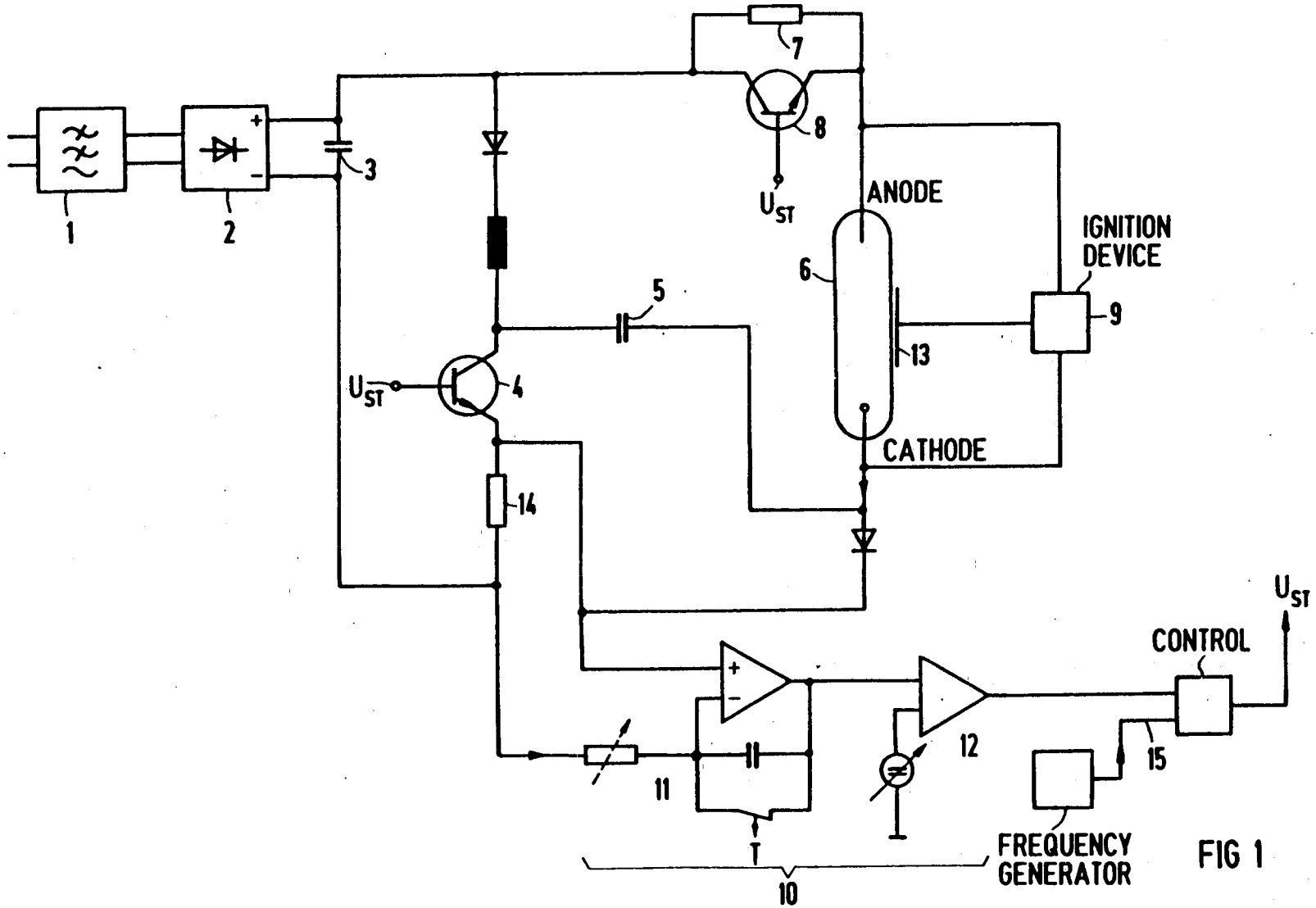
FIG. 1 is a schematic diagram of an ignition circuit of the present invention.

FIG. 1 depicts a main electrical line filter 1 by which the voltage of the main electrical line is supplied to a rectifier 2. A capacitor 3 is connected across the output of the rectifier 2. The rectifier 2 also charges a capacitor 5, which is connected to the gas discharge lamp 6 via a switching transistor 4 in order to generate a photoflash, that is ignition. A heating current flows from the capacitor 3 via a resistor 7, that can be bridged with a switching transistor 8, through the gas discharge lamp 6 during pulse pauses in the pre-ionization phase. The ignition occurs with the assistance of an ignition device 9. A control means 10 having an integrator 11 and a comparator 12 is also provided as shown in FIG. 1.

The capacitor 3 is charged to approximately 310 V via the main electrical line filter 1 and the rectifier 2. The resulting intermediate circuit voltage is supplied, via the resistor 7, to the ignition means 9. Given voltages that are higher than 200 V, the ignition means 9 generates periodic high-voltage pulses of about 6 kV with low energy, for example 2 mWs, that place the gas discharge lamp 6 into the heating mode via the external electrode 13. The heating current of about 100 mA causes a voltage drop of about 200 V across the resistor 7. The difference in potential between the anode and the cathode of the gas discharge lamp 6 drops to about 100 V, at which time the ignition device 9 shuts off the high-voltage pulses.

Figure 2:
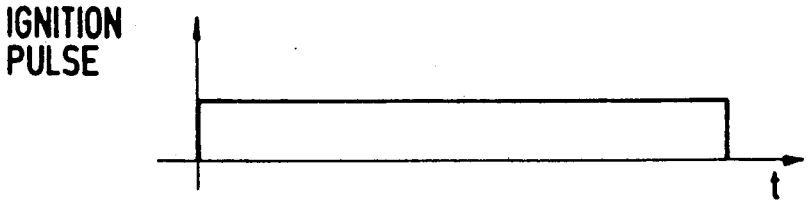
FIGS. 2-6 are graphs of curves for explaining the functioning of the FIG. 1 circuit.
Figure 3:
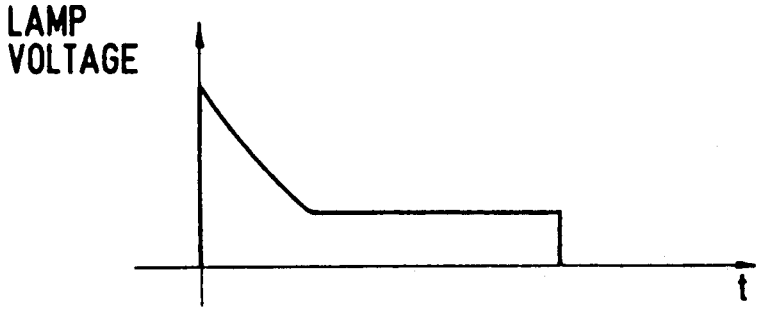
Figure 4:
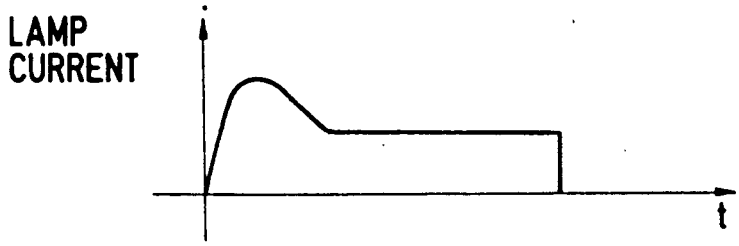

An ignition pulse is shown by way of example in FIG. 2, while FIG. 3 shows the curve of the voltage at the gas discharge lamp 6 and FIG. 4 shows the current through the gas discharge lamp 6 during the ignition.

A constant current-time integral (see FIG. 4) of the current pulses through the gas discharge lamp 6 during the ignition can be set with the control means 10, which has the integrator 11 and the comparator 12. As a result, differences in the current rise time that particularly occur for gas discharge lamps that have aged are compensated by variation of the pulse widths of the current pulses.

Figure 5:
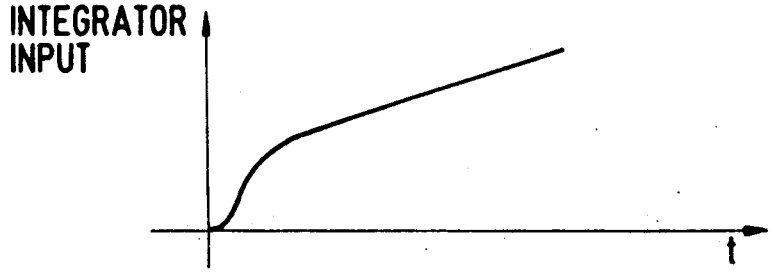
Figure 6:
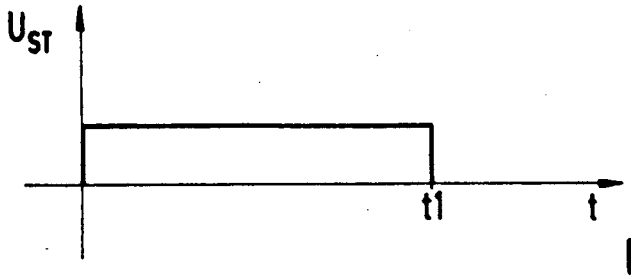

A constant individual photoflash energy can be preselected by setting the threshold of the comparator 12 or the gain of the integrator 11. Thus, compensation can be made for differences in the system sensitivity at different spectral ranges. For example, the use of gray filters as attenuators in color copying devices is superfluous. The signal that corresponds to the gas discharge lamp current and that is taken at the emitter resistor 14 of the switching transistor 4 is chronologically integrated in the integrator 11. When a threshold that can be pre-set is reached, the comparator 12 resets the control signal $U_{ST}$ for the switching transistors 4 and 8. This occurs at time t1. For example, FIG. 5 shows the curve of the input signal of the integrator 11 and FIG. 6 shows the curve of the control signal $U_{ST}$.

The turn-on period T of FIG. 2 is determined by a signal on line 15 in FIG. 1, for example by means of a frequency generator or an external control.

The pulse return portion of the current pulse of FIG. 4 up to time t1 is achieved by activation of the switching transistor 8 and the resulting bridging of the resistor 7.

The invention is not limited to the particular details of the apparatus depicted and other modifications and applications are contemplated. Certain other changes may be made in the above described apparatus without departing from the true spirit and scope of the invention herein involved. It is intended, therefore, that the subject matter in the above depiction shall be interpreted as illustrative and not in a limiting sense.

What is claimed is:

1. Ignition circuit for a gas discharge lamp having at least an anode and a cathode and operated from a main source of power, comprising:

first power source means for generating a heating current for the gas discharge lamp, the first power source connected to said main source of power and, via means for providing a voltage drop across which is connected a first means for switching, connected to the anode of the gas discharge lamp;

second power source means for ignition of the gas discharge lamp, the second power source means connected, via a second means for switching, to the cathode of the gas discharge lamp and connected to the main source of power; and means for controlling for holding constant the current-time integral of current pulses through the gas discharge lamp during ignition, the means for controlling having at least one input for receiving a signal corresponding to current flowing through the gas discharge lamp and an output connected to said first and second means for switching.

2. The apparatus according to claim 1, wherein said means for controlling has an integrator with a first input operatively connected to the cathode of the gas discharge lamp and a comparator having a first input connected to an output of the integrator and a second input connected to means for setting a threshold.

3. The apparatus according to claim 2, wherein said integrator has means for changing the gain of the integrator.

4. The apparatus according to claim 2, wherein said means for setting a threshold is adjustable.

* * * * *